US011878253B1

(12) United States Patent
Benn

(10) Patent No.: US 11,878,253 B1
(45) Date of Patent: Jan. 23, 2024

(54) HAND OCCUPYING DEVICE

(71) Applicant: Renee Benn, Finleyville, PA (US)

(72) Inventor: Renee Benn, Finleyville, PA (US)

( * ) Notice: Subject to any disclaimer, the term of this patent is extended or adjusted under 35 U.S.C. 154(b) by 92 days.

Patent file contains an affidavit/declaration under 37 CFR 1.130(b).

(21) Appl. No.: 17/177,299

(22) Filed: Feb. 17, 2021

(51) Int. Cl.
*A63F 9/06* (2006.01)
*A63F 7/30* (2006.01)
*A63F 9/00* (2006.01)

(52) U.S. Cl.
CPC ..... *A63F 9/0602* (2013.01); *A63F 2007/303* (2013.01); *A63F 2009/0013* (2013.01); *A63F 2250/602* (2013.01)

(58) Field of Classification Search
CPC ..... A63F 2009/0013; A63F 2250/602; A63F 9/0602; A63F 2007/303; A61M 21/02; A61K 36/185; B65D 77/08; A61F 5/14
See application file for complete search history.

(56) References Cited

U.S. PATENT DOCUMENTS 4,627,110 A * 12/1986 Tengs ..... G09F 21/026 428/187
6,135,274 A * 10/2000 James ..... A46B 11/0003 206/362.2
2008/0305461 A1* 12/2008 Nichols ..... G09B 1/32 434/245
2011/0177479 A1* 7/2011 King ..... A63F 3/00145 446/268
2016/0374851 A1* 12/2016 Smith ..... A61F 7/02 607/114
2021/0151166 A1* 5/2021 Schmid ..... G16H 50/20

OTHER PUBLICATIONS

Picking Stones, sold on Etsy by user Beck T (Year: 2021).*
"Travel Toothbrush Capsule" (NPL YouTube video, published by @airlenhousewares6037 on Jul. 13, 2018 at https://www.youtube.com/shorts/Aur9l9Dg_n4) (Year: 2018).*
Picking Stones Pick Rocks Peel and Pick stones Pick and Peel Dermatillomania Skin Picking. Product Listing [online]. © 2021 Etsy, Inc. [retrieved on Jan. 21, 2021]. Retrieved from the Internet: <URL: https://www.etsy.com/listing/919807386/picking-stones-pick-rocks-peel-and-pick?ga_order=most_relevant&ga_search_type=all&ga_view_type=gallery&ga_search_query=skin+picking&ref=sr_gallery-1-2&bes=1>.
Pick 'N Peel Stones. Social Media Account [online]. Facebook. [retrieved on Oct. 26, 2020]. Retrieved from the Internet: <URL: https://www.facebook.com/picknpeelstones/>.
Ultra Sticky Ball—Sensory Fidget Toy. Product Listing [online]. Copyright © 2021 Curious Minds Busy Bags [retrieved on Feb. 5, 2021]. Retrieved from the Internet: <URL: https://www.curiousmindsbusybags.com/products/ultra-sticky-ball-sensory-fidget-tou?_pos=1&_sid=31cb44b6b&_ss=r>.

(Continued)

*Primary Examiner* — Michael D Dennis
(74) *Attorney, Agent, or Firm* — Rowan TELS LLC

(57) ABSTRACT

A hand occupying device and system of use is a lava rock or synthetic equivalent having a plurality of pits disposed about the exterior surface of the lava rock into which a soft and dried latex glue is disposed. A user utilizing a dental pick or similar device may then remove both the dried and pliable latex glue from each individual pit.

16 Claims, 4 Drawing Sheets

(56) References Cited

OTHER PUBLICATIONS

PA113 Squishy TPR Sponge Slow Rising Simulate Peeling Mango Toy—Yellow—3177035012. Product Listing [online]. Pinterest [retrieved on Oct. 26, 2020]. Retrieved from the Internet: <URL: https://www.pinterest.com/pin/701506079438731864/>.

Acerich 3 Pack Edamame Keychain Fidget Toys—Squeeze-a-Bean Puchi Puti Mugen Keyring Pea Keychain Soybean Toys Gift. Product Listing [online]. © 1996-2021, Amazon.com, Inc. [retrieved on Oct. 26, 2020]. Retrieved from the Internet: <URL: https://www.amazon.com/Acerich-Squeeze-Edamame-Keychain-Extrusion/dp/B0725T84VT/ref=sr_1_27?dchild=1&keywords=skin%2Bpicking%2Bfidget&qid=1603140307&sr=8-27&th=1>.

DIY Floating Lava Rock Island (pic heavy). Product Listing [online]. Poppa Ryno's Aquatics™, a subsidiary of PRAquatics LLC, & praquatics.com © 2016-2019 [retrieved on Oct. 26, 2020]. Retrieved from the Internet: <URL: https://praquatics.com/forums/threads/diy-floating-lava-rock-island-pic-heavy.2862/>.

Adhesives to use for gluing Lava Rock to itself. Forum [online]. VerticalScope Inc. © 2016-2019 [posted on Sep. 28, 2011; retrieved on Oct. 26, 2020]. Retrieved from the Internet: <URL: https://www.aquariumforum.com/threads/adhesives-to-use-for-gluing-lava-rock-to-itself.19888/>.

* cited by examiner

HAND OCCUPYING DEVICE

RELATED APPLICATIONS

None.

FIELD OF THE INVENTION

The presently disclosed subject matter is directed to a hand occupying device and system of use.

BACKGROUND OF THE INVENTION

Playing with handheld toys such as Playdoh®, Silly Putty®, marbles, jacks, balls, and Yo-Yos have been providing fun entertainment for both children and adults for many years. These devices certainly gained popularity due to their relative simplicity, affordability and perhaps most importantly, the ability to entertain the mind—if only for a short time. In modern times—a more recent development has been what is commonly known as a fidget toy. These toys are designed to be manipulated in the hand of user in an almost absentminded fashion. The generally accepted theory is that in manipulating the device—a user may counterintuitively focus his or her mind on other tasks such as reading or problem solving.

While fidget toys are certainly popular, they are not to every person's liking. As a result, some individuals have sought other methods and means to "fidget" without utilizing a fidget spinner. The development of the hand occupying device fulfills this need in a manner which is fun, safe, and affordable.

SUMMARY OF THE INVENTION

The principles of the present invention provide for a hand occupying system or system kit, having a porous body which in turn has a top surface with a plurality of concave openings and a bottom, a layer of material filling at least one of the plurality of concave openings, a picking device having a handle and an elongated shaft to facilitate gripping by the user, a storage container for storing the picking device and a bottle of the material applying another layer of the material to the porous body once all material has been removed. The container includes a cavity configured for disposal of the picking device and the container resists and/or prevents the picking device from dulling.

The concave openings may include a cross-section selected from the group consisting of a circular cross-section, an oval cross-section, an oblong cross-section, a triangular cross-section, a rectangular cross-section, a square cross-section, a polygonal cross-section, an irregular cross-section, a uniform cross-section, a non-uniform cross-section, a variable cross-section, or a tapered cross-section. The bottom of the porous body may be configured to fit in a user's hand. The porous body may be a lava rock. The material may include a liquid latex material that is peelable once dried and applied to the surface of the concave openings. The material may dry but does not harden. The handle may include at least one arcuate end which is configured to grab and/or pull the material from the concave openings.

The at least one arcuate end may include a pointed tip which may be configured to scrape the material from the surface and pull the material from the openings. The bottle of the material may include a spout which may be configured to dispense the material into the porous body.

A method for utilizing a hand occupying system has the steps of coating a porous body with a liquid latex material, allowing the material to cover a porous body surface and flow into a plurality of concave openings, letting the material set with the porous body, utilizing a picking device to dig, scrape, pick, grab and/or pull material from the concave openings and the porous body surface, and replying the material from a bottle of material.

BRIEF DESCRIPTION OF THE DRAWINGS

The advantages and features of the present invention will become better understood with These and other features, aspects, and advantages of the present disclosure will become better understood with regard to the following description, appended claims, and accompanying drawings where:

DESCRIPTIVE KEY

Figure 1:
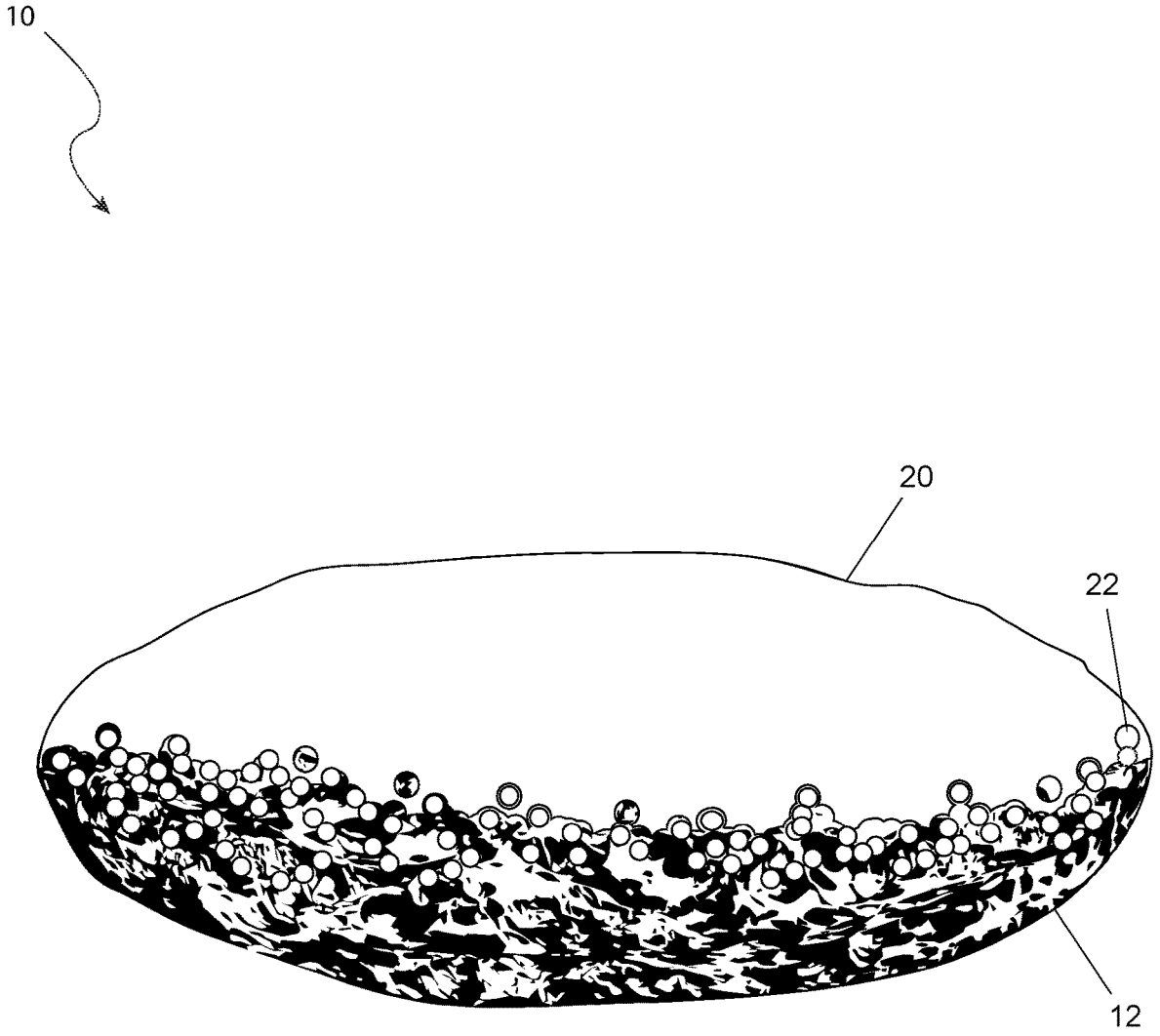
FIG. 1 is a perspective view of a hand occupying system, according to an embodiment of this disclosure.
Figure 2:
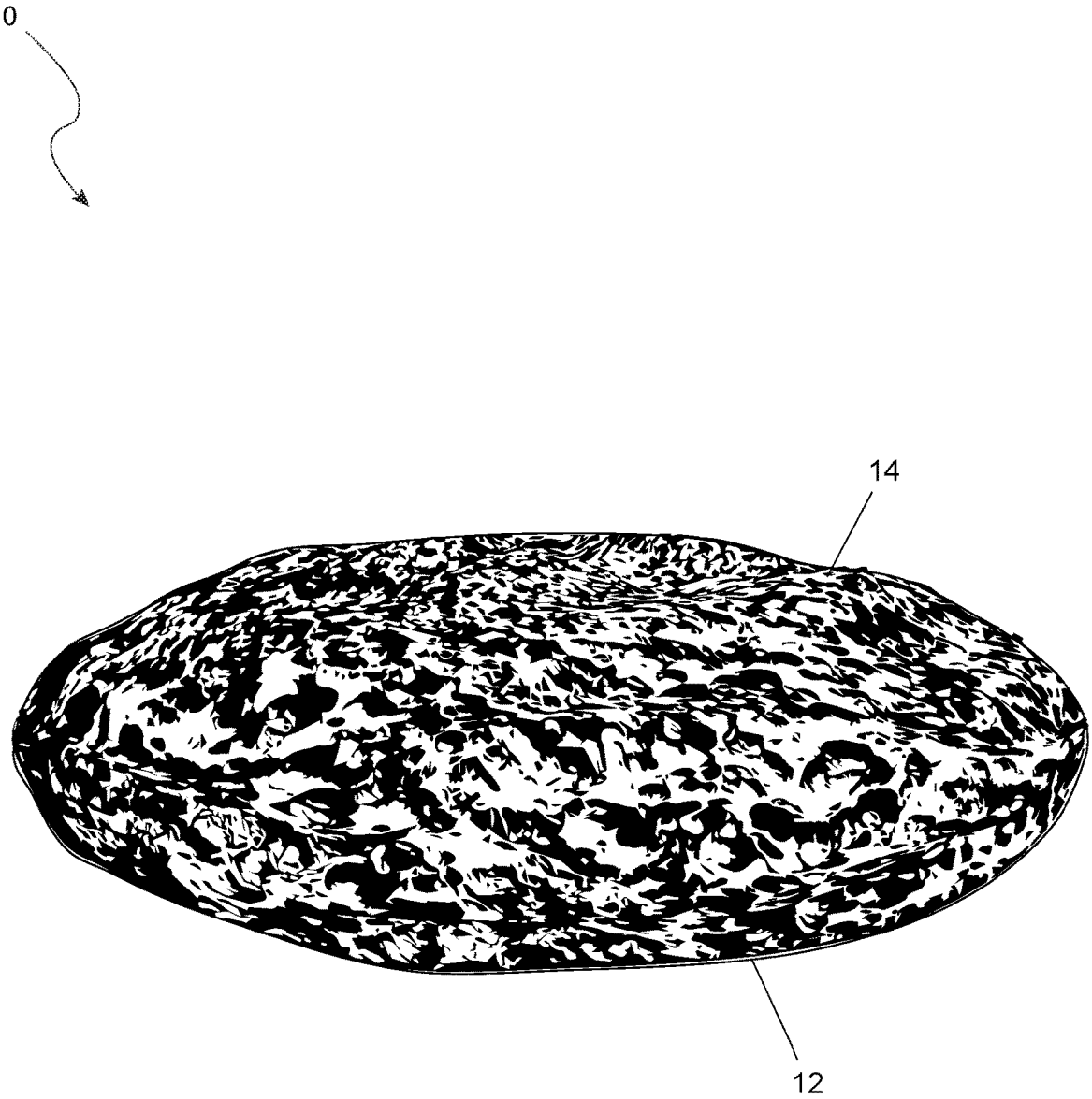
FIG. 2 is a side view of a top view of a hand occupying system, according to an embodiment of this disclosure.
Figure 3:
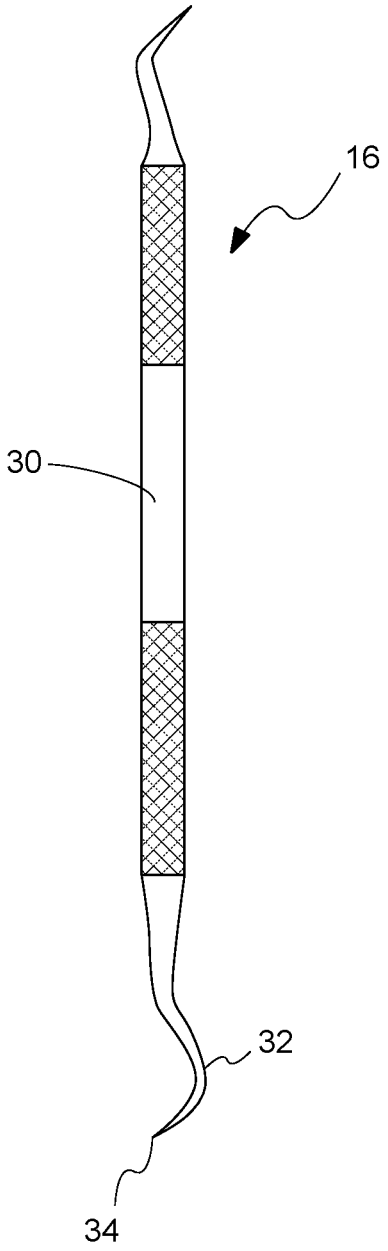
FIG. 3 is a side view of a component of a hand occupying system, according to an embodiment of this disclosure.
Figure 4:
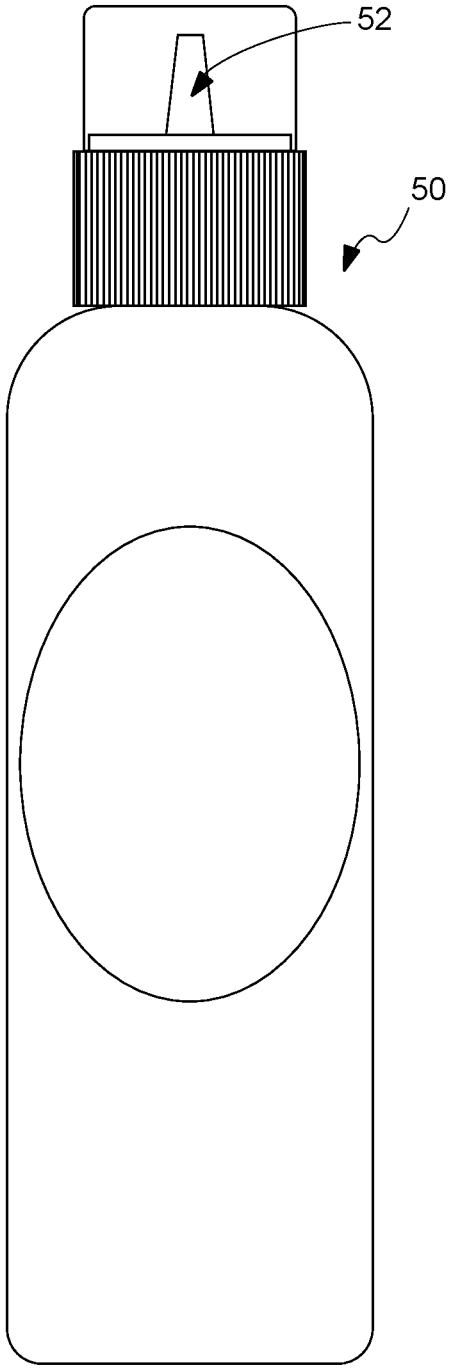
FIG. 4 is a side view of a component of a hand occupying system, according to an embodiment of this disclosure.
Figure 5:
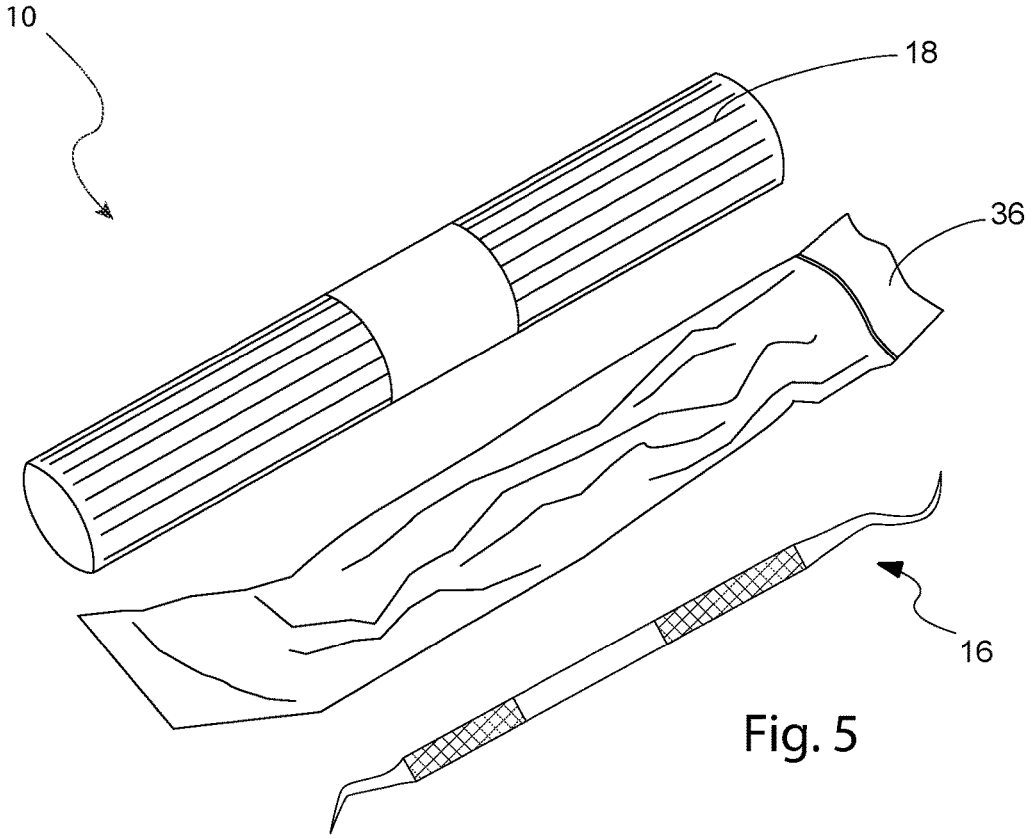
FIG. 5 is a side view of a component of a hand occupying system, according to an embodiment of this disclosure; and, FIG. 6 is a perspective view of a hand occupying system, according to an embodiment of this disclosure.

10 hand occupying system
12 porous body
14 material
16 picking device
18 storage container
20 surface
22 opening
30 handle
32 arcuate end
34 pointed tip

DETAILED DESCRIPTION

The following disclosure is provided to describe various embodiments of a hand occupying device and system. Skilled artisans will appreciate additional embodiments and uses of the present invention that extend beyond the examples of this disclosure. Terms included by any claim that may be presented in any yet-to-be-filed non-provisional patent application are to be interpreted as defined within this disclosure. Singular forms should be read to contemplate and disclose plural alternatives. Similarly, plural forms should be read to contemplate and disclose singular alternatives. Conjunctions should be read as inclusive except where stated otherwise.

Expressions such as "at least one (1) of A, B, and C" should be read to permit any of A, B, or C singularly or in combination with the remaining elements. Additionally, such groups may include multiple instances of one (1) or more element in that group, which may be included with other elements of the group. All numbers, measurements, and values are given as approximations unless expressly stated otherwise.

Various aspects of the present disclosure will now be described in detail, without limitation. In the following disclosure, a hand occupying device and system configured to allow a user to occupy their hands. For example, the continuous movement of one's hands can release dopamine and serotonin to facilitate easing stress, boredom, anxiety, or aid in relaxing. Skilled readers should not view the inclusion of any alternative labels as limiting in any way.

Figure 6:
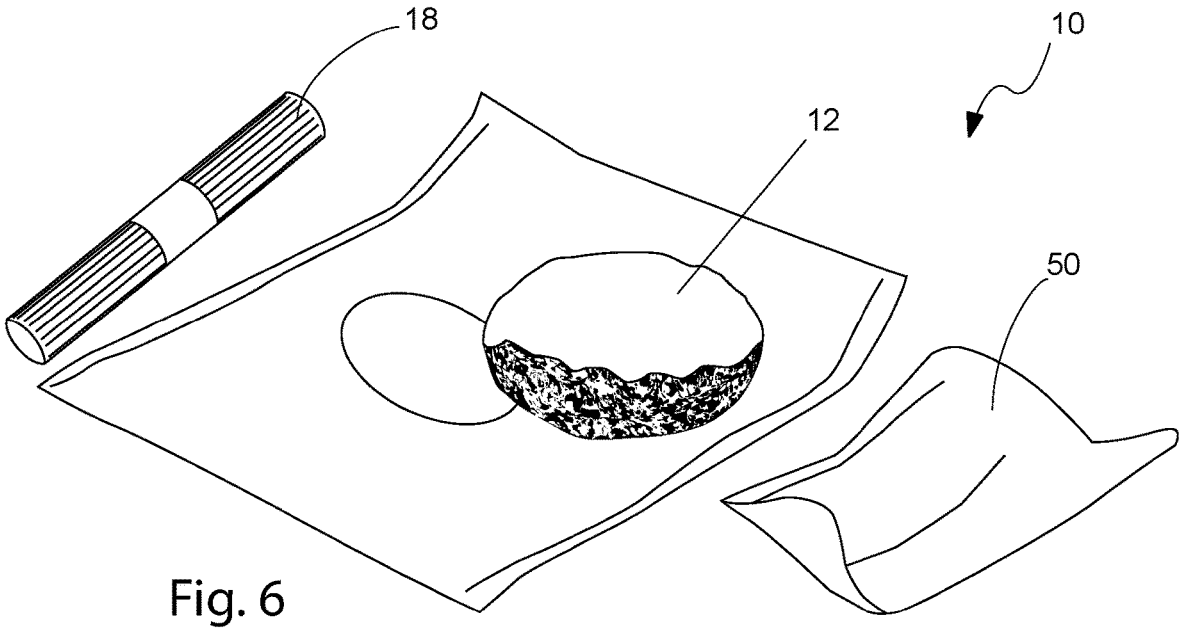

Referring now to FIGS. 1-6, an illustrative hand occupying system 10 will now be discussed in more detail. In some embodiments, hand occupying system 10 includes various components that can be offered as a kit, for example, porous body 12, a layer of material 14, a picking device 16, a storage container 18 and a bottle of material 50, as shown in FIG. 6.

Porous body 12 may be for example, a lava rock. In some embodiments, body 12 includes a top surface 20 that forms a plurality of concave openings 20. Openings 22 can include various cross sections, for example, circular, oval, oblong, triangular, rectangular, square, polygonal, irregular, uniform, non-uniform, variable, and/or tapered. Openings 22 are configured to be filed with material 14. In some embodiments, material 14 includes a liquid latex material that is peelable once dried. Material 14 is applied to surface 20 such that material 14 fills openings 22. Material 14 is configured to dry on surface 20 but not harden. This allows for removal of material 14 from openings 22 and surface 20. Material 14 can be removed from openings 22 and surface 20 by picking and/or scraping. Body 12 includes a bottom surface 24 configured to fit in the hand of the user. In some embodiments, body 12 may include various sizes.

A picking device 16 includes a handle 30 having, for example, an elongated shaft to facilitate gripping by the user. In some embodiments, handle 30 includes at least one (1) arcuate end 32 configured to grab and/or pull material 14 from openings 22. In some embodiments, end 32 includes a pointed tip 34 configured to scrape material 14 from surface 20 and pull material 14 from openings 22.

In some embodiments, the kit includes container 18 provided to store device 16. Storage container 18 includes a cavity configured for disposal of picking device 16. Storage container 18 is configured to resist and/or prevent device 16 from dulling. In some embodiments, picking device 16 is secured in a sanitized covering 36 prior to use. The storage container 18 is an elongated cylindrical case 18A.

In some embodiments, the kit includes a bottle 50 of material 14 to allow the user to apply another layer of material 14 to porous body 12 once all material 14 has been removed by the user. Bottle 50 includes a spout 52 configured to allow the user to dispense material 14 into porous body 12, as described herein.

A method of manufacturing hand occupying includes coating a porous body 12 with a liquid latex material 14. Allowing material 14 to cover surface 20 and flow into openings 22. Letting material 14 set with body 12. Utilizing a picking device 16 to dig, scrape, pick, grab and/or pull material 14 from openings 22 and surface 20.

While various aspects of the present invention have been described in the above disclosure, the description of this disclosure is intended to illustrate and not limit the scope of the invention. The invention is defined by the scope of the claims of a corresponding nonprovisional utility patent application and not the illustrations and examples provided in the above disclosure. Skilled artisans will appreciate additional aspects of the invention, which may be realized in alternative embodiments, after having the benefit of the above disclosure. Other aspects, advantages, embodiments, and modifications are within the scope of the claims of a corresponding nonprovisional utility patent application.

What is claimed is:

1. A hand occupying system kit, comprising:

a porous body having a top surface with a plurality of concave openings and a bottom;

a layer of a material filling some of the concave openings;

a picking device having a handle and an elongated shaft to facilitate gripping by a user;

a storage container storing the picking device, the container includes a cavity configured for disposal of the picking device and the container resists and/or prevents the picking device from dulling; and a bottle of the material applying another layer of the material to the porous body once all material has been removed;

wherein the picking device is secured in a sanitized covering prior to use; and wherein the storage container is an elongated cylindrical case.

2. The hand occupying system kit, according to claim 1, wherein the concave openings include a cross-section selected from the group consisting of a circular cross-section, an oval cross-section, an oblong cross-section, a triangular cross-section, a rectangular cross-section, a square cross-section, a polygonal cross-section, an irregular cross-section, a uniform cross-section, a non-uniform cross-section, a variable cross-section, or a tapered cross-section.

3. The hand occupying system kit, according to claim 1, wherein the bottom of the porous body is configured to fit in a user's hand.

4. The hand occupying system kit, according to claim 1, wherein the porous body is a lava rock.

5. The hand occupying system kit, according to claim 1, wherein the material includes a liquid latex material that is peelable once dried and applied to the surface of the concave openings.

6. The hand occupying system kit, according to claim 5, wherein the material dries but does not harden.

7. The hand occupying system kit, according to claim 1, wherein the handle includes at least one arcuate end configured to grab and/or pull the material from the concave openings.

8. The hand occupying system kit, according to claim 7, wherein the at least one arcuate end includes a pointed tip configured to scrape the material from the surface and pull the material from the openings.

9. The hand occupying system kit, according to claim 1, wherein the bottle of the material includes a spout configured to dispense the material into the porous body.

10. A hand occupying system, comprising:

a porous body having a top surface with a plurality of concave openings and a bottom;

a layer of a material filling the concave openings;

a picking device having a handle and an elongated shaft to facilitate gripping by a user;

a storage container storing the picking device, the container includes a cavity configured for disposal of the picking device and the container resists and/or prevents the picking device from dulling; and a bottle of the material applying another layer of the material to the porous body once all material has been removed;

wherein the material includes a liquid latex material that is peelable once dried and applied to the surface of the concave openings;

wherein the material dries but does not harden;

wherein the picking device is secured in a sanitized covering prior to use; and wherein the storage container is an elongated cylindrical case.

11. The hand occupying system, according to claim 10, wherein the concave openings include a cross-section selected from the group consisting of a circular cross-section, an oval cross-section, an oblong cross-section, a triangular cross-section, a rectangular cross-section, a square cross-section, a polygonal cross-section, an irregular cross-section, a uniform cross-section, a non-uniform cross-section, a variable cross-section, or a tapered cross-section.

12. The hand occupying system, according to claim 10, wherein the bottom of the porous body is configured to fit in a user's hand.

13. The hand occupying system, according to claim 10, wherein the porous body is a lava rock.

14. The hand occupying system, according to claim 10, wherein the handle includes at least one arcuate end configured to grab and/or pull the material from the concave openings.

15. The hand occupying system, according to claim 14, wherein the at least one arcuate end includes a pointed tip configured to scrape the material from the surface and pull the material from the openings.

16. The hand occupying system, according to claim 10, wherein the bottle of the material includes a spout configured to dispense the material into the porous body.

* * * * *